US005218012A

United States Patent [19]

Berger

[11] Patent Number: 5,218,012

[45] Date of Patent: Jun. 8, 1993

[54] PROCESS FOR COATING FIBERS AND APPLICATIONS THEREOF TO THE PRODUCTION OF COMPOSITE MATERIALS

[75] Inventor: Michel Berger, Castelnau-de-Medoc, France

[73] Assignee: Pradom Limited, London, England

[21] Appl. No.: 613,125

[22] Filed: Nov. 15, 1990

Related U.S. Application Data

[62] Division of Ser. No. 281,193, Dec. 7, 1988, Pat. No. 5,000,980.

[30] Foreign Application Priority Data

Dec. 11, 1987 [FR] France ..... 87 17340

[51] Int. Cl.[5] ..... C08K 9/02

[52] U.S. Cl. ..... 523/204; 523/215; 523/217; 523/300

[58] Field of Search ..... 523/204, 215, 217, 300

[56] References Cited

U.S. PATENT DOCUMENTS

| | | | |
|---|---|---|---|
| 3,572,286 | 3/1971 | Forney | 118/49.5 |
| 3,834,916 | 9/1974 | Kesler | 106/99 |
| 4,060,648 | 11/1977 | Taylor-Brown | 427/32 |
| 4,061,827 | 12/1977 | Gould | 428/368 |
| 4,229,328 | 10/1980 | Makino et al. | 523/215 |
| 4,244,847 | 1/1981 | Posiviata et al. | 523/205 |
| 4,388,370 | 6/1983 | Ellis et al. | 428/368 |
| 4,664,936 | 5/1987 | Ueno et al. | 427/38 |
| 4,853,253 | 8/1989 | Katoh | 427/54 |

FOREIGN PATENT DOCUMENTS

| | | |
|---|---|---|
| 0130575 | 1/1985 | European Pat. Off. . |
| 2180696 | 11/1973 | France . |
| 85/7143 | 9/1985 | South Africa . |

*Primary Examiner*—Paul R. Michl
*Assistant Examiner*—Edward Cain
*Attorney, Agent, or Firm*—Weingarten, Schurgin, Gagnebin & Hayes

[57] ABSTRACT

The present invention relates to a process for coating reinforcing elements preferably in fiber form, wherein said material is treated, between two electrodes, by the field obtained by means of a direct electric current of voltage included between 50 and 150,000 V and/or by means of an alternating electric current of frequency between 50 and 1,000 Hz and of voltage included between 10,000 and 30,000 V, and said element is placed in contact with a powder of a conductive or semi-conductive material.

10 Claims, No Drawings

PROCESS FOR COATING FIBERS AND APPLICATIONS THEREOF TO THE PRODUCTION OF COMPOSITE MATERIALS

This application is a division of U.S. Ser. No. 07/281,193, now U.S. Pat. No. 5,000,980.

FIELD OF THE INVENTION

The present invention relates to a process for coating fibers and to applications thereof to the production of composite materials.

BACKGROUND OF THE INVENTION

It is known to make composite materials constituted by a reinforcing element (for example fiber) and a matrix in which said reinforcing element is embedded. It is also known that the properties of the composite materials obtained depend a great deal not only on the nature and the properties of the materials which compose them but also on the possibilities of catching (interfacial properties) between the matrix and the reinforcing element. A certain amount of research has therefore been directed towards the modification of the superficial properties of the reinforcing element in order to render it compatible (or catching better) with the matrix.

Within the scope of such research, a process has already been described in which the reinforcing elements (fibers) were subjected, by passage between two electrodes, to electrostatic fields produced by the use of direct and/or alternating electric currents under high voltage. It has been indicated that the electrostatic field produced from a direct current essentially caused a swelling of the reinforcing elements and that the electrostatic field produced from an alternating current caused an etching of the surface of the reinforcing elements and possibly a partial oxidation of said surface. It will be recalled that the electric currents used—the same as those employed in the present invention—have, for the direct currents, a voltage of 50,000 and 150,000 V and, for the alternating currents, a frequency of between 50 and 1,000 Hz (preferably between 200 and 500 Hz) and a voltage of between 10,000 and 30,000 V. These properties of the electrostatic fields bring about a modification of the catching between the reinforcing element and the matrix and consequently a modification (generally an improvement) of the properties of the composite material obtained.

SUMMARY OF THE INVENTION

It has now been found that this same treatment of reinforcing elements by electrostatic fields produced by the use of direct and/or alternating electric currents makes it possible to coat said reinforcing elements with a powder of conductive or semi-conductive material.

A reinforcing element is thus obtained which is constituted by the initial reinforcing element whose surface has been coated with a very adherent thin layer of the material in conductive or semi-conductive powder form.

This new reinforcing element obviously presents surface properties different from those of the initial reinforcing material and may therefore be used either for improving the properties of composite materials comprising said initial reinforcing element, or for making composite materials by a fresh combination of this new reinforcing element with certain matrices.

The reinforcing elements which may be coated are numerous, for example elements made of glass, aromatic polyamide, boron, carbon, silicon carbide, flax, hemp and, more generally, any material of plant origin (cellulosic materials for example). The process of coating is especially advantageous in the case of materials of plant origin (cellulosic materials, flax, hemp, jute, etc..). Of course, the operational conditions of the process for obtaining a suitable coating of these various products will depend on said products; said conditions will be indicated hereinafter.

These reinforcing elements may take various forms, but, most often, they are in the form of more or less oriented fibers, flock or pulp.

The product used for making the coating is constituted by a powder of a conductive or semi-conductive material or a mixture of powders of these materials; among the powders which may be used, mention will be made for example of carbon, graphite, magnesium oxide, silver oxide, copper oxide or bromide, zinc oxide, titanium oxide, all these powders seem to be characterized by a relatively high electrical potential with respect to other powders presenting a low or zero electrical potential. The conductive or semi-conductive materials that may be used may be defined as materials whose resistivity, in volume, is less than $10^{10}$ ohm/cm$^3$.

The process used consists in spraying the powders on the reinforcing elements whilst the latter are subjected to the electrostatic field produced by two electrodes, as indicated hereinabove. In certain cases, it is possible to spray the powders in a medium containing the reinforcing element which is subjected simply to the electrostatic field produced by a direct current; however, most often, it is preferable to operate, as described previously, by firstly subjecting the reinforcing element to a field produced by a direct current (which provokes a considerable swelling of the reinforcing element), then by subjecting the swollen element to the field produced by an alternating current and then to inject the powder into the medium containing the element subjected to said field. Depending on the fibers, it is sometimes desirable to effect these operations at a temperature higher than the ambient temperature (for example from 25° to 60° C.) so as to facilitate and accelerate possible phenomena of superficial oxidation provoked, on the element, by the field.

As indicated hereinabove, the process must be adapted in particular to the reinforcing elements used; the parameters which are made to vary are, apart possibly from the potential applied to the electrodes, the spaced apart relationship of said electrodes and the duration of the treatment. For example, for reinforcing elements made of carbon, said elements are subjected to the field produced by a direct current of about 100,000 V applied on electrodes distant by 10 mm, the duration of application being about 10 mins. If reinforcing elements made of aromatic amide are used, the potential of 100,000 V may be applied to electrodes separated by 7 mm and the duration of application will be about 5 mins. If the field comes from an alternating current, the distance between the electrodes will be all the greater as the reinforcing elements will be more conductive; by way of example, reinforcing elements made of glass will advantageously be treated by applying a potential of 15 to 30,000 V between two electrodes spaced apart by about 20 mm, the duration of application being about 3 to 5 mins.

It is clear to the man skilled in the art that the reinforcing elements subjected to these electrical fields will receive a certain electrical charge which will contribute to ensuring good adherence, on these elements, of the powders of conductive or semi-conductive material.

Finally, it will be noted that the phenomenon of etching undergone by the reinforcing elements subjected to an electric field produced by an alternating current is definitive, whilst the phenomenon of swelling undergone by the reinforcing elements subjected to an electric field produced by a direct current is transitory and of a duration which varies depending on the nature of said elements, ranging for example from 2 to 3 mins. for glass to about 30 mins. for the aromatic polyamides.

As indicated previously, the reinforcing elements coated according to the invention may be used in very different matrices. Virtually any known organic matrix conventionally used for making composite materials may be employed, for example epoxy resins, organic/inorganic resins, thermoplastics, ceramics and hydraulic setting products or poor organic resins.

In fact, it has been found that the coated reinforcing elements could consequently acquire an advantageous compatibility with respect either to hydraulic setting materials or with respect to materials constituted by a poor inorganic resin (glue or binding agent based on silica) laden with suitable metal oxide (for example alumina). For example, novel materials comprising a reinforcing element which is a jute fiber coated with carbon and a matrix constituted by plaster or cement, have thus been able to be produced.

The following non-limiting Examples illustrate the invention:

EXAMPLE 1

Jute fibers oriented in polydirectional manner are heated to about 40° C. and deposited between two electrodes supplied by a direct current of 100,000 V. After a duration of the order of 2 to 3 mins., a fine powder of graphite is sprayed in the space between said electrodes and the current is maintained for about 2 mins.

It is observed that the jute fibers have been coated with a thin layer (of the order to 2 to 4 μm) of graphite.

EXAMPLE 2

Glass fibers in the form of strands are placed between two electrodes supplied by a direct current of 100,000 V; after about 2 mins., a considerable swelling of the strand is observed (the apparent volume thereof has been multiplied by about 4).

The same electrodes were then supplied by an alternating current of 25,000 V for a duration of 3 mins.; graphite powder is then injected between said electrodes, and a direct current of 50,000 V is applied for 2 mins.

Swollen glass fibers coated with a layer of about 3 μm of graphite are collected.

EXAMPLE 3

Cellulosic fibers in the form of a light flock are placed between two electrodes supplied by an alternating current of 20,000 V; a very fine powder of copper oxide is introduced in the space between these electrodes and the current is maintained for 3 mins.

Cellulosic fibers coated with a very adherent thin layer (about 3 μm) of copper oxide are collected.

EXAMPLE 4

The fibers coated with graphite obtained in Example 1 are taken and introduced between two electrodes supplied by an alternating electric current of 30,000 V. After 5 mins. treatment, it is observed that the coated fibers had undergone a superficial etching.

This test proves that the coated fibers according to the invention may undergo, like the fibers described in the prior art, phenomena of swelling, etching and possibly of superficial oxidation when they are disposed between electrodes supplied by a high-voltage field produced by a direct and/or alternating current.

EXAMPLE 5

The fibers obtained according to Example 1 are disposed in a mould having the shape of the desired finished object (plate for example); there is poured into this mould a quantity, sufficient to fill the mould, of a mixture constituted by cement, water (mixing water) and a binding agent.

The cement is left to set hydraulically and a plate is demoulded, presenting properties at least equal to those of known fibrocement plates. The same experiment is carried out, replacing the cement by plaster and a very resistant plaster plate is obtained; in order to obtain a very resistant plaster plate according to the present invention, which is white in colour, a reinforcing element constituted by jute fibers coated with titanium oxide will for example be used.

What is claimed is:

1. A composite material constituted by the dispersion, in a known matrix of reinforcing elements, preferably in fiber form, resulting from the steps of:

treating said reinforcing elements by subjecting said reinforcing elements to an electric field between two electrodes;

said treating step producing a swelling of said reinforcing elements; and placing said swollen reinforcing elements in contact with a powder of conductive or semi-conductive material.

2. The composite material of claim 1 wherein said powder is a conductive or semi-conductive material selected from the group consisting of carbon, graphite, magnesium oxide, and titanium oxide.

3. The composite material of claim 1, wherein said reinforcing elements are under fiber form, and are selected from the group consisting of glass aromatic polyamide, boron, carbon, silicon carbide, flax, hemp, jute and an organic fiber of plant origin particularly of a cellulosic material.

4. A composite material constituted by the dispersion in a known matrix of the coated reinforcing elements of claim 1 wherein said reinforcing elements include a plurality of fibers oriented in polydirectional manner to form a bundle of fibers, obtained through the following steps:

treating said reinforcing elements by subjecting said reinforcing elements to an electric field between two electrodes;

said treating step producing a transitory swelling of said bundle of fibers;

placing said swollen bundle of fibers in contact with a powder of conductive or semi-conductive material such that surface coating of each of said plurality of fibers in said bundle of fibers is achieved.

5. A composite material constituted by coated reinforcing elements, preferably in fiber form, dispersed in a matrix constituted by a hydraulically setting compound, the coated reinforcing elements resulting from the steps of:

treating said reinforcing elements by subjecting said reinforcing elements to an electric field between two electrodes;

said treating step producing a swelling of said reinforcing elements; and placing said swollen reinforcing elements in contact with a powder of conductive or semi-conductive material.

6. The composite material of claim 5 wherein said powder is a conductive or semi-conductive material selected from the group consisting of carbon, graphite, magnesium oxide, and titanium oxide.

7. The composite material of claim 5, wherein said reinforcing elements are under fiber form, and are selected from the group consisting of glass aromatic polyamide, boron, carbon, silicon carbide, flax, hemp, jute and an organic fiber of plant origin particularly a cellulosic material.

8. A composite material constituted by the dispersion in a matrix constituted by a hydraulically compound of the coated reinforcing elements of claim 1 wherein said reinforcing elements include a plurality of fibers oriented in polydirectional manner to form a bundle of fibers, obtained through the following steps:

treating said reinforcing elements by subjecting said reinforcing elements to an electric field between two electrodes;

said treating step producing a transitory swelling of said bundle of fibers;

placing said swollen bundle of fibers in contact with a powder of conductive or semi-conductive material such that surface coating of each of said plurality of fibers in said bundle of fibers is achieved.

9. The composite material of claim 1, wherein said treating step is continued after said step of placing said swollen reinforcing elements in contact with a powder of conductive or semi-conductive material.

10. The composite material of claim 1, wherein said step of placing said swollen reinforcing elements in contact with a powder of conductive or semi-conductive material occurs during said treating step.

* * * * *

UNITED STATES PATENT AND TRADEMARK OFFICE

CERTIFICATE OF CORRECTION

PATENT NO. : 5,218,012

DATED : June 8, 1993

INVENTOR(S) : Michel Berger

It is certified that error appears in the above-indentified patent and that said Letters Patent is hereby corrected as shown below:

Column 2, line 22, "oxide, all" should read --oxide, .....; all--.

Column 4, line 55-56, "elements of claim 1 wherein" should read --elements wherein--.

Column 6, line 3, "elements of claim 1 wherein" should read --elements wherein--.

Signed and Sealed this

Fifth Day of July, 1994

Bruce Lehman

*Attest:*

BRUCE LEHMAN

*Attesting Officer*

*Commissioner of Patents and Trademarks*